United States Patent [19]

Sakano et al.

[11] Patent Number: 5,074,066

[45] Date of Patent: Dec. 24, 1991

[54] CORDLESS IRON HAVING WATER AND ELECTRICAL SUPPLIES RESPONSIVE TO AN IRON REST

[75] Inventors: Chikashi Sakano, Yao; Seiichi Nakada, Sanda; Toyohiko Yagi, Takatsuki; Takahisa Tsuji, Osaka, all of Japan

[73] Assignee: Matsushita Electric Industrial Co., Ltd., Osaka, Japan

[21] Appl. No.: 567,212

[22] Filed: Aug. 14, 1990

[30] Foreign Application Priority Data

Aug. 17, 1989 [JP] Japan ..... 1-211620
Aug. 18, 1989 [JP] Japan ..... 1-213394

[51] Int. Cl.[5] ..... D06F 75/16; D06F 75/28; D06F 75/40; H05B 3/06

[52] U.S. Cl. ..... 38/77.8; 38/79; 38/96; 38/88; 219/247

[58] Field of Search ..... 38/77.8, 77.5, 77.7, 38/77.9, 79, 85, 88, 94, 107, 142, 96; 219/240, 241, 242, 245–247, 251

[56] References Cited

U.S. PATENT DOCUMENTS

| | | | |
|---|---|---|---|
| 1,494,156 | 5/1924 | De Atley | 38/77.6 |
| 2,714,650 | 8/1955 | Werner | 219/25 |
| 2,820,877 | 1/1958 | Oates, Jr. | 219/25 |
| 3,398,260 | 8/1968 | Martens | 219/247 |
| 3,760,149 | 9/1973 | Harsanyi | 219/247 |
| 4,650,268 | 3/1987 | Dobson et al. | 339/40 |
| 4,656,763 | 4/1987 | Kawasaki et al. | 38/77.8 X |
| 4,688,339 | 8/1987 | Tsai | 38/77.7 |
| 4,719,334 | 1/1988 | Rebel | 38/107 X |

FOREIGN PATENT DOCUMENTS

| | | | |
|---|---|---|---|
| 0279780 | 10/1988 | European Pat. Off. | 219/247 |
| 3208603 | 8/1983 | Fed. Rep. of Germany | 219/247 |
| 1094900 | 1/1989 | Japan | 219/247 |
| 0488756 | 7/1938 | United Kingdom | 219/246 |
| 0795905 | 6/1958 | United Kingdom | 38/88 |
| 2160229 | 12/1985 | United Kingdom . | |

*Primary Examiner*—Werner H. Schroeder
*Assistant Examiner*—Ismael Izaguirre
*Attorney, Agent, or Firm*—Panitch, Schwarze, Jacobs & Nadel

[57] ABSTRACT

A cordless iron which includes an iron body and a rest upon which the iron body is mounted when the ironing is not being done, the iron body including a soleplate and a steam chamber both heated through electrical connection effected by the mounting of the iron body on the rest, the steam ejection being stopped when the iron body is mounted on the rest.

12 Claims, 6 Drawing Sheets

CORDLESS IRON HAVING WATER AND ELECTRICAL SUPPLIES RESPONSIVE TO AN IRON REST

BACKGROUND OF THE INVENTION

1. Field of the Invention

The present invention relates to a cordless iron used for ironing out wrinkles in clothes etc., and more particularly to a cordless iron having a rest upon which the iron body is mounted when the ironing is not being done, during which the soleplate of the iron body is heated so as to be ready for the subsequent ironing, and while the ironing is carried out, the soleplate is disconnected from the power source.

2. Description of the Prior Art

Many kinds of cordless irons are known, and typical examples are shown as follows:

One type is disclosed in the U.S. Pat. No. 2,714,650 or 3,760,149, in which the iron body is horizontally mounted on the rest.

Another type is disclosed in the U.S. Pat. No. 2,820,877 or Japanese Laid-Open Patent Publication No. 59-232597, in which the iron body is mounted on the rest at a tilt.

A further type is disclosed in the U.S. Pat. No. 3,398,260 or 4,650,268, in which the iron body is mounted upright on the rest with its heel portion downward.

In these types of cordless irons the iron bodies are provided with a terminal connected to a power source, and the rests are provided with an electrode for connection to the terminal and a cord connected to the electrode.

By mounting the iron body on the rest, the soleplate of the iron body is automatically heated through the energizing of the heater contained therein. By dismounting the iron body from the rest, the soleplate is electrically disconnected from the power source, and the ironing is carried out. As the ironing goes on, the soleplate gradually cools to temperatures at which the wrinkles cannot be ironed. To maintain the soleplate at a temperature sufficient to iron out wrinkles in clothes, it is required to repeat the mounting and dismounting of the iron body on the rest.

The continuous mounting and dismounting of a heavy iron body tires the users' wrists and arms, and it is especially hard for old people and women.

In order to avoid the fatigue of arms and wrists, the rest is commonly constructed so that the iron body is mounted on the rest from above or from the side. However, the following problems arise:

(1) While the head of the iron body is directed upwards, steam continues to eject through the upward nozzle, and the user must switch off the steam button every time the iron body is mounted on the rest;

(2) The frequent switching operation is troublesome, and the ironing takes time;

(3) If steam continues to eject even when the ironing is not being done, the steam becomes less than that required for ironing out the wrinkles in the cloth; and (4) To make up for the shortage of steam, more electric energy is required for making more steam than that required for heating the soleplate of the iron body. As a result, the user must wait until the soleplate becomes sufficiently heated. The ironing process consumes time.

SUMMARY OF THE INVENTION

The cordless iron of the present invention, which overcomes the above-discussed and numerous other disadvantages and deficiencies of the prior art, comprises an iron body including a soleplate having a heater, a rest having a connection to a power source, the rest being adapted to allow the iron body to be mounted when the ironing is not being done, a steam chamber provided in the soleplate, a water tank connected to the steam chamber, the iron body and the rest comprising means for effecting mutual electrical connection, and a steam stopping means operable responsive to the mounting of the iron body on the rest, and a stop means for suspending the water supply to the steam chamber.

In a preferred embodiment, the cordless iron further comprises a valve disposed in a path connecting the tank to the steam chamber, the valve being operable responsive to the mounting of the iron body on the rest.

In another embodiment, the valve is disposed at the outlet of the steam chamber.

In a further preferred embodiment, the stop means comprises a first means provided on the iron body and a second means provided on the rest, the first means being coupled to the second means when the iron body is mounted on the rest.

According to another aspect of the present invention the cordless iron comprises an iron body including a soleplate having a heater, a rest having a connection to a power source, the rest being adapted to allow the iron body to be mounted when the ironing is not being done, a steam chamber provided in the soleplate, a water tank connected to the steam chamber through a water passageway, a pump provided in the water passageway, the iron body and the rest comprising means for effecting mutual electrical connection, and a steam stopping means operable responsive to the mounting of the iron body on the rest, and a stop means for suspending the water supply to the steam chamber.

In a preferred embodiment, the cordless iron further comprises a heat responsive valve provided in the water passageway connecting the tank to the steam chamber, the heat responsive valve blocking the water passageway in response to a drop in the temperature below a predetermined temperature.

According to a further aspect of the present invention, the cordless iron comprises an iron body including a soleplate having a heater, a rest having a connection to a power source, a steam chamber provided in the soleplate, a water tank connected to the steam chamber, the rest having a receiving portion for the iron body, the receiving portion comprising a first shifter adapted to allow the iron body to move to the power source by its own weight, and a second shifter adapted to allow the iron body to shift to the first shifter by its own weight, thereby ensuring that the iron body is smoothly accommodated in the receiving portion of the rest for electrical connection whether it is mounted either from above or from the side, the iron body and the rest comprising means for mutual electrical connection, and a steam stopping means operable responsive to the mounting of the iron body on the rest, and a stop means for suspending the water supply to the steam chamber.

In a preferred embodiment, the electrical connection is effected by a receiving means provided on the iron body and a projecting means provided in the rest, the projecting means adapted for reception in the receiving means.

In another embodiment, the receiving portion for the iron body is tilted toward the electrical power connection in the rest, and the first shifter comprises a plurality of rollers.

According to a still further aspect of the present invention, the cordless iron comprises an iron body including a soleplate having a heater, a rest having a connection to a power source, the rest being adapted to allow the iron body to be mounted when the ironing is not being done, a steam chamber provided in the soleplate, a water tank connected to the steam chamber, the water tank comprising a valve at its outlet operable responsive to the mounting of the iron body on the rest, the iron body and the rest comprising means for effecting mutual electrical connection, and a steam stopping means operable responsive to the mounting of the iron body on the rest, and a stop means for suspending the water supply to the steam chamber.

According to another aspect of the present invention, the cordless iron comprising an iron body including a soleplate having a heater, a rest having a connection to a power source, the rest being adapted to allow the iron body to be mounted when the ironing is not being done, a steam chamber provided in the soleplate, a water tank connected to the steam chamber through a water passageway, the iron body and the rest comprising means for effecting mutual electrical connection, a steam stopping means operable responsive to the mounting of the iron body on the rest, a stop means for suspending the water supply to the steam chamber, a pump provided in the water passageway, the iron body and the rest comprising means for mutual electrical connection, and a steam suspending means operable responsive to the mounting of the iron body on the rest, and a stop means for suspending the water supply to the steam chamber.

According to a further aspect of the present invention, the cordless iron comprising an iron body including a soleplate having a heater, a rest having a connection to a power source, a steam chamber provided in the soleplate, a water tank connected to the steam chamber, the rest having a receiving portion for the iron body, the receiving portion comprising a first shifter adapted to allow the iron body to move to the power source by its own weight, and a second shifter adapted to allow the iron body to shift to the first shifter by its own weight, thereby ensuring that the iron body is smoothly accommodated in the receiving portion of the rest for electrical connection whether it is mounted either from above or from the side, the iron body and the rest comprising means for mutual electrical connection, and a steam stopping means operable responsive to the mounting of the iron body on the rest, a stop means for suspending the water supply to the steam chamber, the electrical connection between the iron body and the rest being effected by a receiving means provided on the iron body and a projecting means provided in the rest, the projecting means adapted for reception in the receiving means.

Thus, the invention described herein makes possible the objectives of (1) providing a cordless iron capable of stopping the ejection of steam every time the iron body is mounted on the rest, (2) providing a cordless iron capable of ejecting a relatively large quantity of steam at one time depending upon the wrinkles to be ironed out, and (3) providing a cordless iron capable of heating the soleplate in a shorter period of time, thereby speeding up the ironing process.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
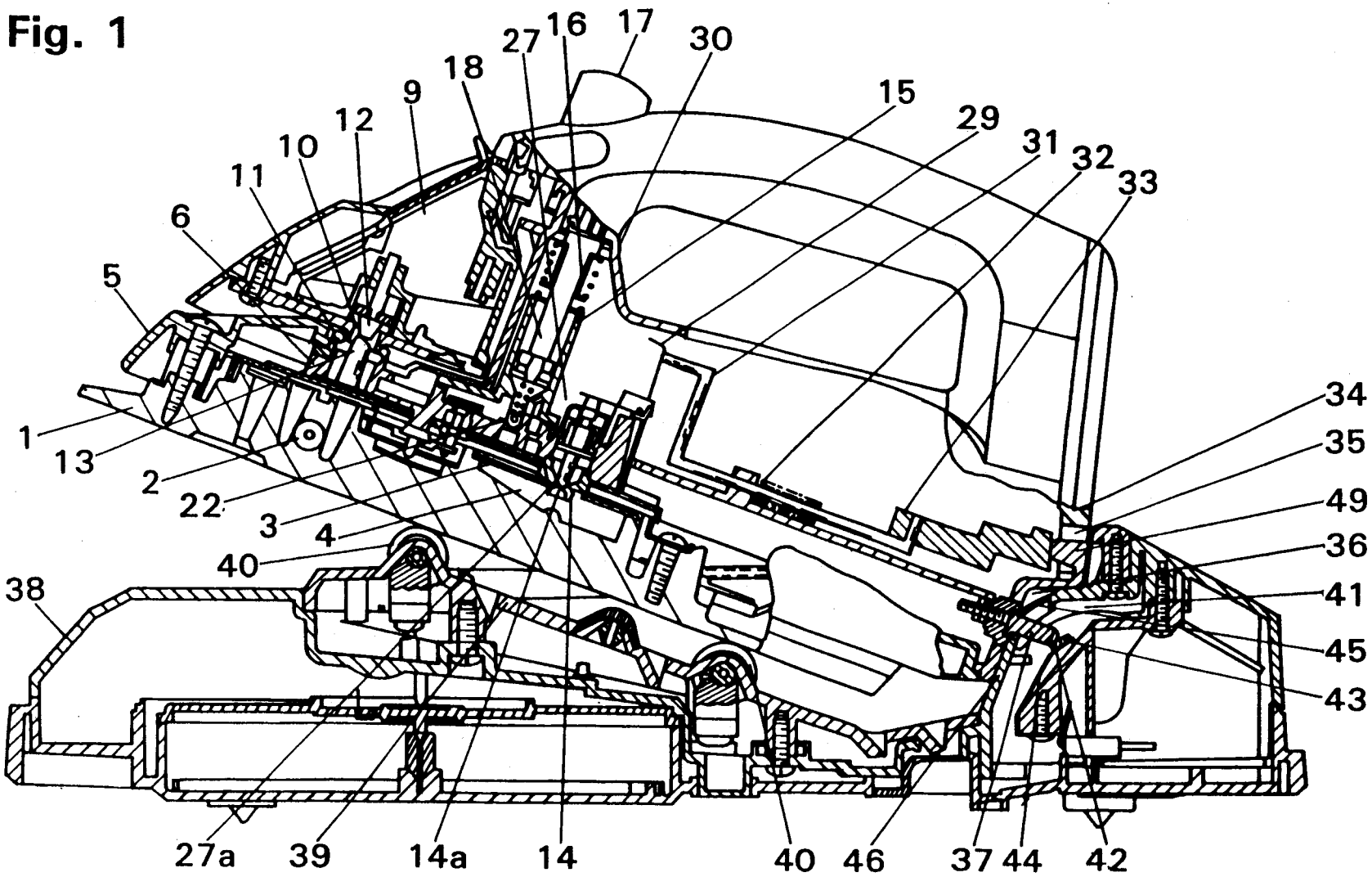
FIG. 1 is a vertical cross-section through a cordless iron according to the present invention.
Figure 2:
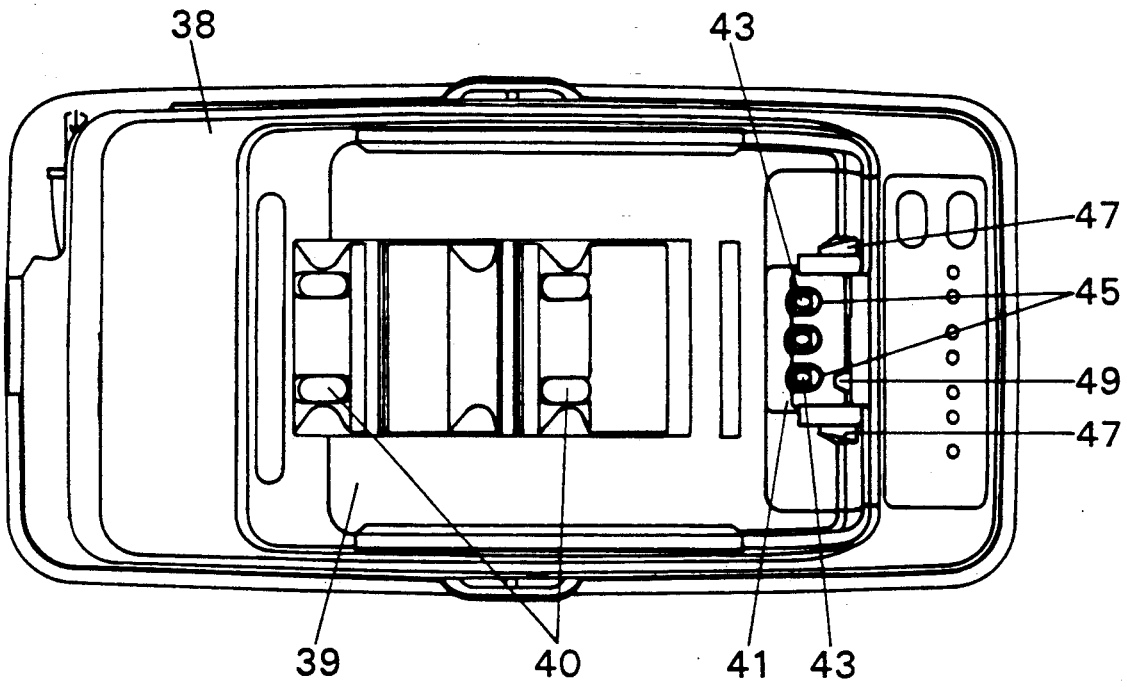
FIG. 2 is a top view showing a rest on which the iron body is mounted.
Figure 3:
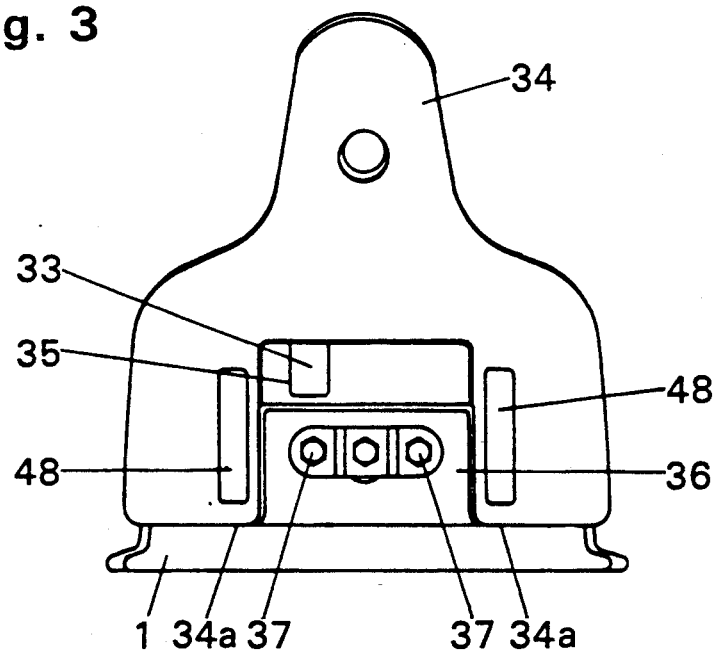
FIG. 3 is a rear view showing the iron body.
Figure 4:
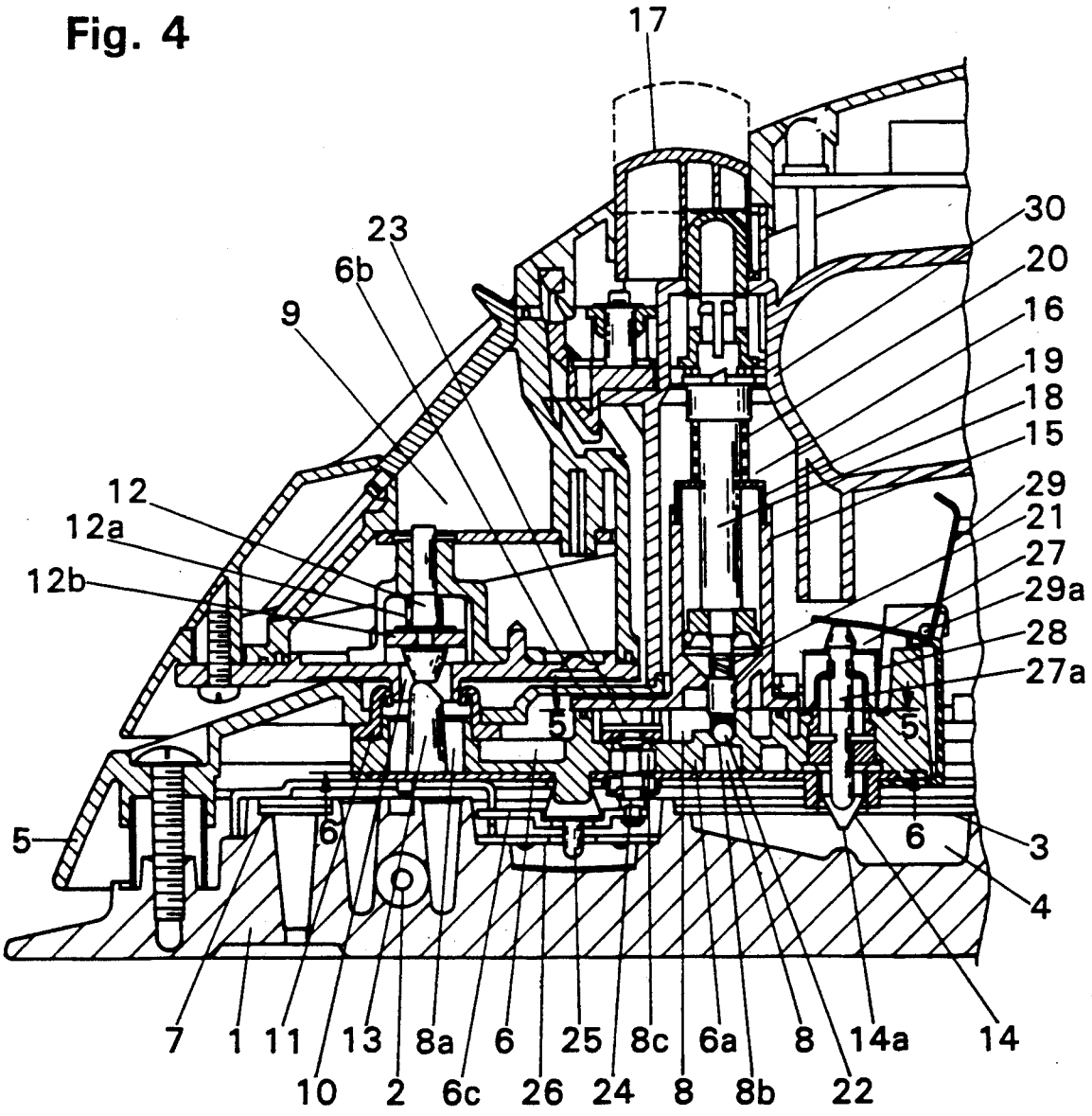
FIG. 4 is a cross-sectional view on a larger scale showing a main portion of the iron body.
Figure 5:
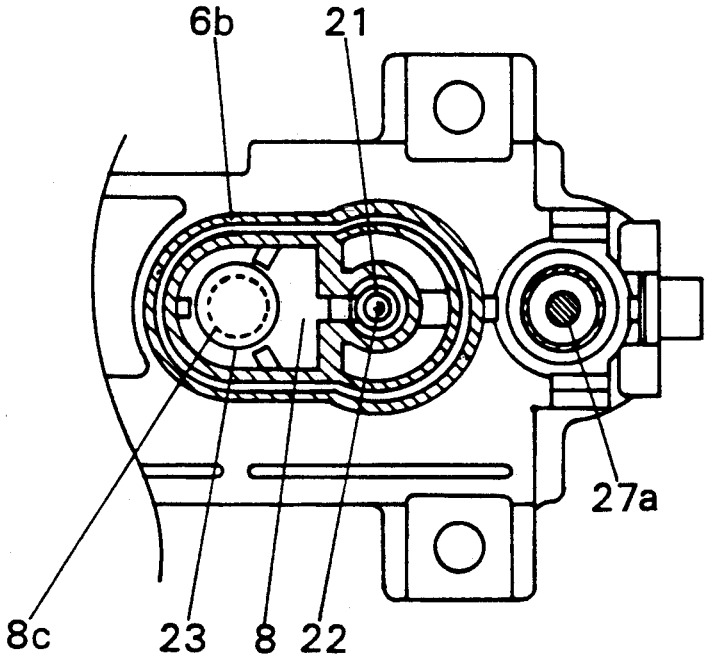
FIG. 5 is a cross-sectional view taken along the line 5—5 in FIG. 4.
Figure 6:
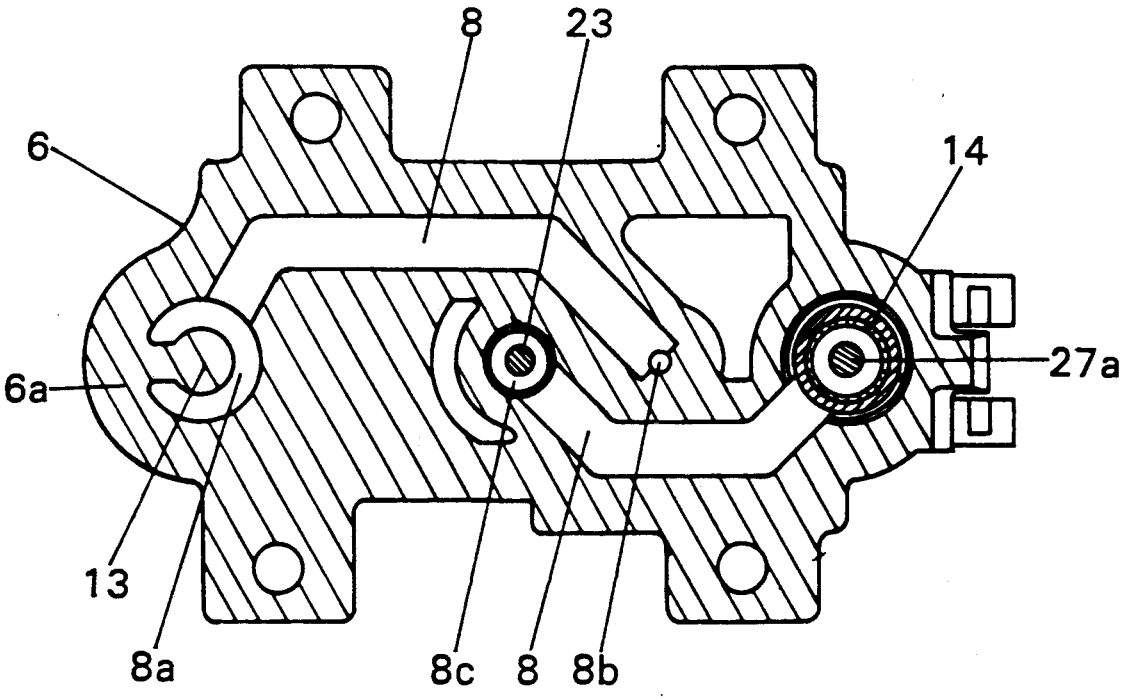
FIG. 6 is a cross-sectional view taken along the line 6—6 in FIG. 4.

Referring to FIGS. 1 to 9, the iron body includes a soleplate 1 of aluminum alloy in which a heater 2 is embedded to heat the soleplate. The iron body includes a steam chamber 4 covered with a cover 3. The water in the steam chamber 4 is vaporized by the heater 2. The soleplate 1 is covered with a shield 5 of heat-proof plastic. There is provided a water channel 6 fixed on a supporting plate 7 disposed on the upper side of the soleplate 1, and the water channel 6 positioned between the soleplate 1 and the shield 5. This water channel 6 constitutes a water passage 8 together with a plurality of members **6*a* and 6*b* of heat-proof plastic, wherein the members 6*a* and 6*b* are joined by a known method such as by heat or micro wave welding. The water passage 8 is connected to its winding portion, also denoted by the reference numeral 8, and there is provided a rubber sheet 6*c* on the under side of the member 6*a*. The passage 8 has an entrance 8*a* through which water flows opens in the upper surface of the shield 5, and is watertightly joined to a water supply port 10 of a detachable tank 9 through a packing 11. The water supply port 10 includes a valve 12 provided on the bottom part of the tank 9. The valve 12 is normally closed by a spring 12*a*. When the tank 9 is mounted, the valve 12 is moved upward by a lift portion 13 formed with the water channel 6 in a single unit, and the water supply port 10 is opened to allow the water to flow into the tank 9 through the entrance 8*a*. When the tank 9 is dismounted, the valve 12 is separated from the lift portion 13. Therefore, a valve sheet 12*b* is pushed to close the water supply port 10 by the spring 12*a*. also, on the outlet side of the water channel 6 is provided a nozzle portion 14. The water flowing through the passage 8 is limited to a predetermined amount at a small aperture 14*a* of the nozzle portion 14 so that the water may drop onto the bottom surface of the steam chamber 4. The water in the tank 9 is supplied into the steam chamber 4 connected thereto by the passage 8 formed in the water channel 6**.

There is provided a pump 16 having a cylinder 15, the pump 16 being integral with the member **6*b* of the water channel 6. The cylinder 15 is vertically disposed with respect to the water channel 6, and is connected between the entrance 8***a* of the passage 8 and the nozzle portion 14 (i.e. the outlet) thereof. The pump 16 is provided with a piston 18 which is manually operated by a steam button 17. The steam button 17 is designed to move the piston 18 of the pump 16 up and down, and effects change-over between "steam" and "dry" through its press operation. The pump 16 is biased upwards by a first spring 19 provided between the cylinder 15 and piston 18. The steam button 17 is biased upwards by a second spring 20 which is stronger than the first spring 19. When the steam button 17 is moved up and down, its stroke is exactly transferred to the piston 18, and in order to maintain either the position "steam" or "dry", a suitable tool in common use such as a spline ratchet is used in the steam button 17.

The reference numeral 21 denotes a spring disposed at the lower end of the piston 18, and the lower end of the spring 21 extends toward the passage 8. The member 6*a* is provided with a bore 8*b* which connects one portion of the passage 8 to the other portion thereof. There is provided a floatable ball 22 normally kept in contact with the top face of the member 6*a* of the water channel 6. The ball 22 is made of plastic and floats up on a stream of water when the water enters in the passage 8. The bore 8*b* is opened and closed by the ball 22 being moved up or down in accordance with the movement of the steam button 17 through the piston 18 and the spring 21. When the steam button 17 is not pressed, the ball 22 is kept apart from the bore 8*b* under its own buoyancy and the stream of water, thereby allowing water to enter the passage 8. When the steam button 17 is pressed, the ball 22 is pushed to close the bore 8*b*. In this way, the water supply is manually conducted for the passage 8 and the steam chamber 4. In addition, when the up and down movements of the steam button 17 are repeated, the pump 16 is operated, thereby enabling the piston 18 to slide up and down in the cylinder 15. Thus, a desired amount of water is forced into the steam chamber 4. This is of particular advantage when a greater amount of steam is needed in ironing.

There is provided a heat responsive valve 23 between the pump 16 and the nozzle portion 14 at the outlet of the passage 8. This valve 23 opens or closes a bore 8*c* which connects the two portions of the passage 8 divided by the member 6*a* of the water channel 6. The reference numeral 24 denotes a bimetal-fuse which drives the heat responsive valve 23 and has a spherical shape whose center is recessed. When the temperature of the soleplate 1 is lower than a predetermined temperature, the bimetal-fuse 24 is virtually in full contact with the soleplate 1 and is remote from a movable member 25. When the soleplate 1 is heated to a predetermined temperature, the bimetal-fuse 24 is turned so as to enable its central portion to move upward so that the movable member 25, normally biased downward by the spring 26, is pushed upward, and the heat responsive valve 23 is operated upward. Thus, the bore 8*c* of the passage 8 is released from the valve 23 and is opened.

On the other hand, when the soleplate 1 cools down below a predetermined temperature, the bore 8*c* is closed. The movable member 25 is supported by the supporting plate 7 at one end and the other end thereof moves up and down to operate the heat responsive valve 23. A predetermined temperature at which the bimetal-fuse 24 is turned is equal to the temperature at which the water supplied in the steam chamber 4 instantly vaporizes. If the temperature of the soleplate 1 is not high enough to vaporize the water in the steam chamber 4, the passage 8 is closed.

The reference numeral 27 denotes a valve which opens and closes the nozzle portion 14 disposed at the outlet of the passage 8. A small aperture 14*a* of the nozzle portion 14 is opened and closed from above by a lever 27*a*. Normally, a spring 28 biases the lever 27*a* upward to keep the nozzle portion 14 open. The reference numeral 29 denotes a movable plate which operates the valve 27 against the spring 28. The movable plate 29 is bent in an L-shape and is disposed at the rear portion of the water channel 6 so that it can rotate in the front and rear direction. One end of the movable plate 29 extends forward from a pin 29*a* disposed at the pivotal center, and is provided on the upper part of the lever 27*a*. The other end thereof extends upward from the pin 29*a*. A handle 30 is provided on the shield 5, surrounding the pump 16, the movable plate 29 and the like. The reference numeral 31 denotes a handling portion disposed in a space between the shield 5 and the handle 30 through a spring 32 so that it can move in the front and back direction. One end of the handling portion 31 is disposed opposite to the rear surface of the other end extending to the upper portion of the movable plate 29. An operating portion 33 of plastic or the like is disposed on the other end of the handling portion 31 so as to effect a unitary movement therewith. The reference numeral 34 denotes a handle back plate disposed on the rear portion of the handle 30, and an aperture 35 is provided at the position opposing to the rear end portion of the operating portion 33. Power is delivered through a contact 36 disposed on the lower portion of an aperture 35. The rear and lower portion of the contact 36 are opened, and a pair of power supply terminals 37 are connected to the soleplate 1.

The iron body is mounted on a rest 38 which also functions as a power source. A receiving portion 39, on which the soleplate 1 is directly mounted, is designed to allow the iron body to be mounted at an upward tilt as shown in FIG. 1. The reference numeral 40 denotes a plurality of rollers projected from the upper surface of the receiving portion 39. The rollers 40 make a space against the soleplate 1, and support the iron body so that the iron body rolls backward by its own weight. The rollers 40 provide a first shifter. The rest 38 is provided with a terminal 41 at the back of the receiving portion 39. when the iron body is mounted on the receiving portion 39, the contact 36 is engaged with the terminal 41 so as to cover it. The terminal 41 includes electrode 42, and when the iron body is mounted on the receiving portion 39, the electrode 42 is connected to the power supply terminal 37. The electrode 42 is composed of a leaf spring 44 with a contact point 43. The reference numeral 45 denotes an aperture disposed at an opposite position to the contact point 43 of a wall 46 of the terminal 41 covering the electrode 42. The aperture 45 is long and narrow without a break throughout the entire length. The reference numeral 47 denotes guide members formed on both sides of the terminal 41. Each guide member 47 projects toward the handle 30 in an arch form, and on both sides of the contact 36 the handle back plate 34 is provided with hollows 48 for allowing the respective guide members 47 to fit in.

Figure 9:
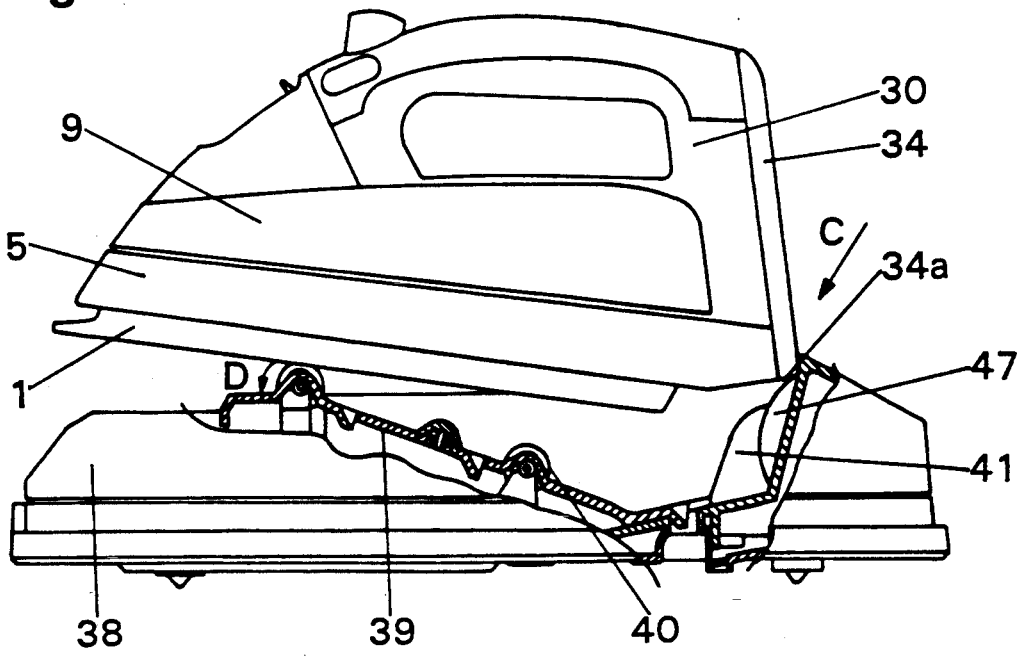

As shown in FIG. 9, when the iron body is mounted on the receiving portion 39 of the rest 38 from above, the guide members 47 pushes the iron body forward so as to enable the soleplate 1 to roll on the rollers 40 by the weight of the iron body. In this way, a second shifter is provided.

When the iron body is mounted on the receiving portion 39, it rolls on the rollers 40 and moves toward the wall 46 by its own weight even when the iron body is mounted on the receiving portion 39 at random, that is, without paying special attention to whether the position of it is proper or not. The power supply terminal 37 of the iron body enters the terminal 41 through the aperture 45, thereby bringing the terminal 37 of the iron body into contact with the contact point 43 of the electrode 42.

The rest 38 is provided with a projection 49 (omitted in FIGS. 8 and 9) located in an opposite position to an aperture 35 formed on the handle back plate 34. When the iron body is mounted on the receiving portion 39, the projection 49 pushes the operating portion 33 against the spring 32, and operates the valve 27 through the movable plate 29 so as to close the nozzle portion 14 and stop the supply of water into the steam chamber 4. When the iron body is dismounted from the rest 38, the water supply is resumed for the steam chamber 4. Since the valve 27 is provided at the outlet of the passage 8 on the side of the steam chamber 4, even when the passage 8 is filled with water, the ejection of steam is stopped as soon as the iron body is mounted on the rest 38.

An example of the operation will be described.

The cordless iron permits a manual changeover between the start and stop of steam ejection while the iron body is dismounted from the rest and being applied to the clothes.

First, when the steam button 17 is pressed against the spring 19, the pump 16 is pushed downward and the bore **8*b* of the passage 8 is closed by the ball 22. Then, when the tank 9 holding water is loaded onto the iron body, the water flows into the passage 8 through the entrance 8*a* thereof and reaches the bore 8*b* after flowing through the passage 8. However, since the bore 8*b* is closed by the ball 22, the water flow is stopped from entering the steam chamber 4**, thereby providing the "dry" condition as referred to above.

Next, when the steam button 17 is released by pressure from the user's finger to allow it to return to the original projecting position, the spring 19 lifts up the pump 16 and the ball 22 floats up from the bore **8*b* of the passage 8 under the water flow passing therethrough, thereby allowing the water to enter the passage 8**.

When the soleplate 1 is heated to a temperature at which water can vaporize, the bimetal-fuse 24 is turned upward and the bore **8*c* of the passage 8 is opened by the heat responsive valve 23, so that the water again enters the passage 8 through the bore 8*c*. While the ironing is being done, the water in the tank 9 flows through the passage 8 and enters the steam chamber 4 wherein the amount of water is controlled when passing through the aperture 14*a***. In this way the steam is ejected.

If the clothing to be ironed requires more steam because of thick wrinkles, the user repeats pushing the steam button 17 to drive the pump 16, the water in the cylinder 15 connected to the passage 8 is forced into the steam chamber 4 and steam is generated and ejected continuously.

When the ironing continues for a relatively long time during which the iron body is dismounted from the rest, and/or when the steam ejection continues for a long time, the soleplate 1 cools below temperatures at which it cannot iron out the wrinkles in the clothes, and the water cannot be vaporized. Unvaporized water is likely to dampen or spoil the clothes. To solve this problem, the present invention ensures that when the soleplate 1 cools to a predetermined temperature at which the water cannot vaporize, the bore **8*c* of the passage 8 is blocked by the heat responsive valve 23, thereby stopping the supply of water into the steam chamber 4**.

When the ironing is not being done, the iron body is mounted on the rest 38, thereby continuing the electrical connection to the power source. Thus, the heater 2 is continuously supplied with power to heat the soleplate 1.

Now, how to stop the steam ejection when the iron body is mounted on the rest 38 under the "steam" condition will be described:

When the iron body is mounted on the rest 38, the projection 49 pushes the handling portion 31 forward against the spring 32 and rotates one end of the movable plate 29 forward. Then, the other end of the movable plate 29 pushes down the lever **27*a* against the spring 28, thereby closing the nozzle portion 14**.

When the iron body is mounted on the rest 38 with the steam button 17 in the "steam" position, the water in the tank 9 reaches the nozzle portion 14 through the passage 8 of the water channel 6. However, the nozzle portion 14 is closed by the lever **27*a*, so that the supply of water is stopped from the steam chamber 4**, thereby producing no steam.

Figure 7:
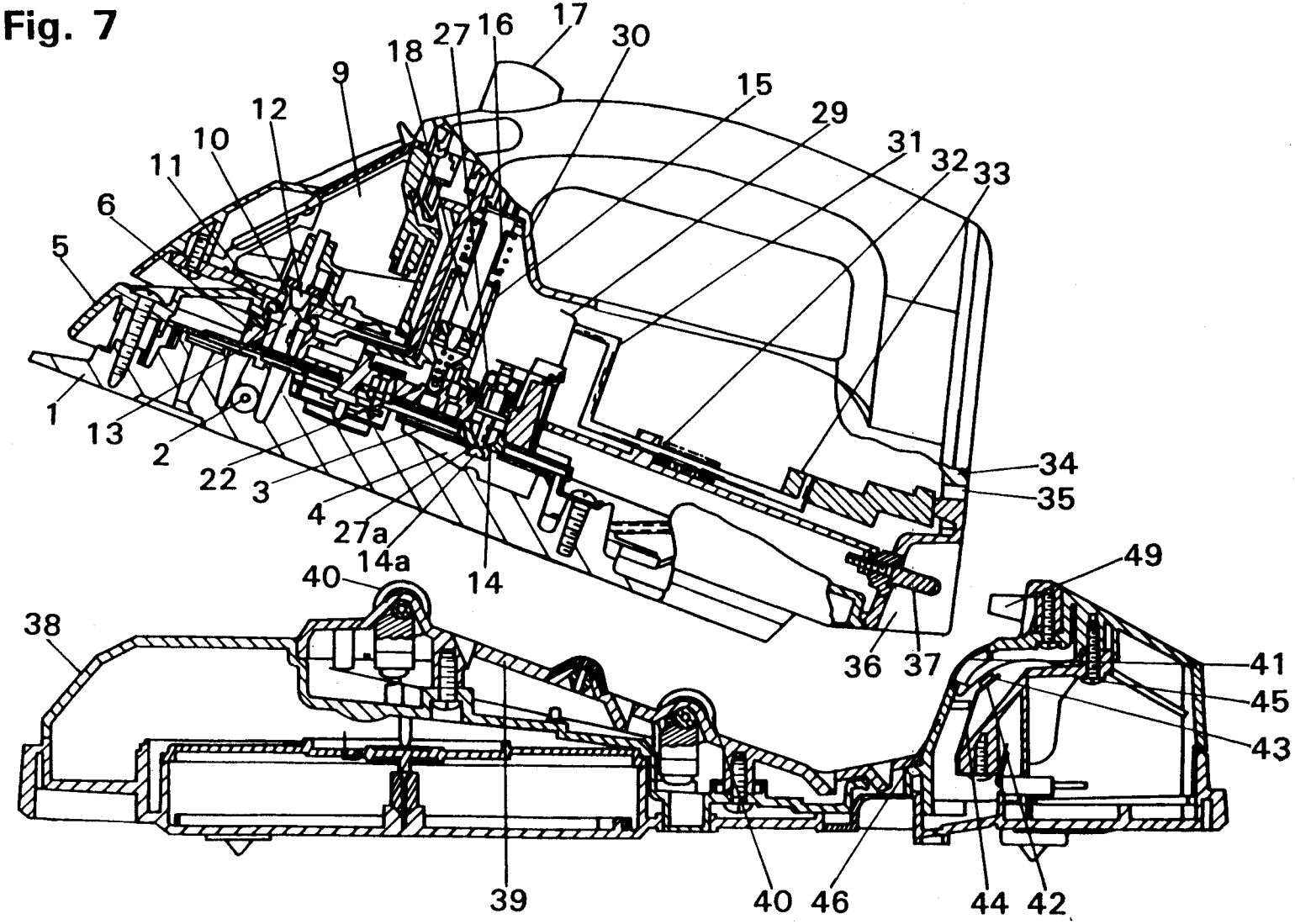
FIG. 7 is a cross-sectional view showing the iron body separated from the rest.

As shown in FIG. 7, when the iron body is removed from the rest 38, the handling portion 31 is released from the projection 49 of the rest 38, so that the handling portion 31 integral with the operating portion 33 is moved backward under the action of the spring 32. Accordingly, the handling portion 31 becomes apart from the movable plate 29, and the spring 28 pushes up the lever **27*a* and the movable plate 29, thereby opening the nozzle portion 14**.

When the steam button 17 is in the "steam" position, the pump 16 is set free from the ball 22, so that the water in the tank 9 flows through the water channel 6. Then a controlled amount of water by the nozzle portion 14 is supplied to the steam chamber 4, thereby producing steam and ejecting same.

In the illustrated embodiment, the outlet of the passage 8 is opened and closed, but it is possible to control the outlet of the tank 9, or alternatively, to control the inlet and outlet of the steam chamber 4.

As is evident from the foregoing description, the supply of water is automatically stopped from the steam chamber 4 when the iron body is mounted on the rest 38, thereby eliminating the necessity of continuous manual operations of the valve. When the iron body is dismounted from the rest 38, the water supply is automatically resumed, thereby making steam required for the subsequent ironing process.

Figure 8:
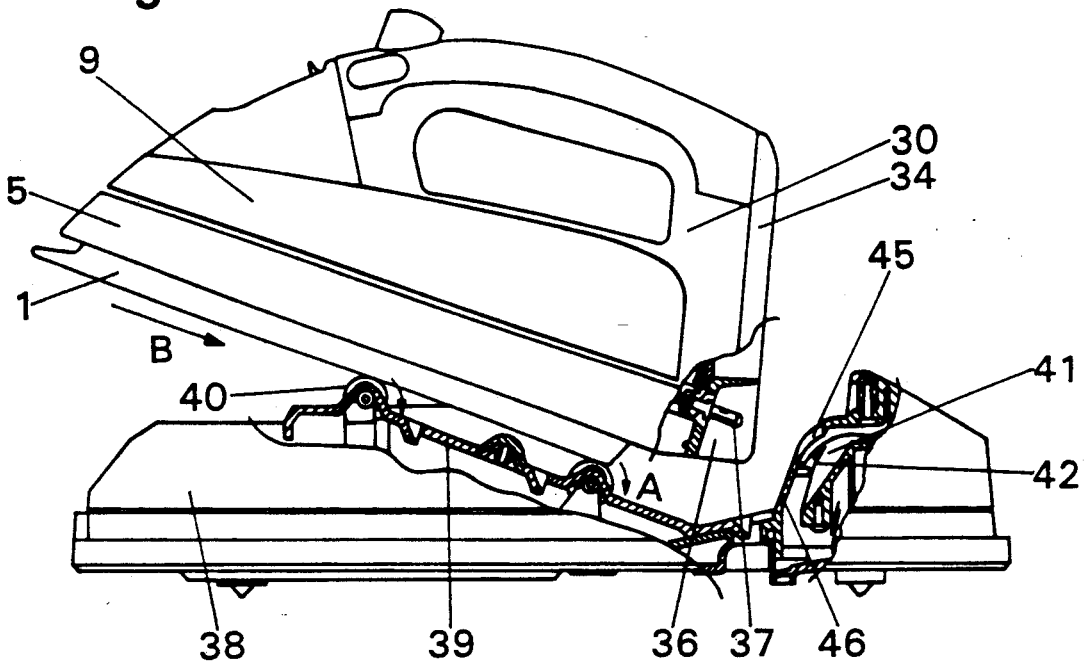
FIGS. 8 and 9 are explanatory views exemplifying the placement of the iron body on the rest.

While the ironing is being done, the user sometimes mounts the iron body on the rest 38 to have a pause or rest. In this case, as shown in FIG. 8, the iron body is horizontally shifted and mounted on the receiving portion 39 from the side on which the iron body rolls on the rotating rollers 40 until it is electrically connected to the power source through the coupling of the power supply terminals 37 with the electrode 42, thereby heating the soleplate 1.

When the iron body is mounted on the rest 38 from above as shown in FIG. 9, the iron body is guided by the guide members 47 and moves down onto the receiving portion 39 by its own weight in the direction of arrow C. The rollers 40 rotate in the direction of arrow D and facilitate the forward movement of the iron body. Likewise, the power supply terminals 37 are connected to the electrode 42.

In this way, the iron body can be mounted either from the side or from above on the rest 38. In either case, the rollers 40 are rotated so as to enable the guide members 47 to fit in the hollows 48 so that the electrical connection between the power supply terminal 37 and the electrode 42 is secured.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A cordless iron comprising an iron body including a soleplate having a heater, a rest having a connection to a power source, the rest enabling the iron body to be mounted when the iron body is not being used, a steam chamber provided in the soleplate, a water tank connected to the steam chamber, the iron body and the rest comprising means for effecting mutual electrical connection, and a steam suspending means operably responsive to the mounting of the iron body on the rest, and a stop means for suspending the water supply to the steam chamber.

2. A cordless iron according to claim 1, wherein the steam suspending means comprises a valve disposed in a path connecting the tank to the steam chamber, the valve being operably responsive to the mounting of the iron body on the rest.

3. A cordless iron according to claim 2, wherein the valve is disposed at an outlet of the steam chamber.

4. A cordless iron according to claim 1, wherein the stop means comprises a first means provided on the iron body and a second means provided on the rest, the first means being coupled to the second means when the iron body is mounted on the rest.

5. A cordless iron comprising an iron body including a soleplate having a heater, a rest having a connection to a power source, the rest enabling the iron body to be mounted when the iron body is not being used, a steam chamber provided in the soleplate, a water tank connected to the steam chamber through a water passageway, a pump provided in the water passageway, the iron body and the rest comprising means for effecting mutual electrical connection, and a steam suspending means operably responsive to the mounting of the iron body on the rest, and a stop means for suspending the water supply to the steam chamber.

6. A cordless iron according to claim 5, wherein the steam suspending means comprises a heat responsive valve provided in the water passageway connecting the tank to the steam chamber, the heat responsive valve blocking the water passageway in response to a drop in the temperature below a predetermined temperature.

7. A cordless iron comprising an iron body including a soleplate having a heater, a rest having a connection to a power source, a steam chamber provided in the soleplate, a water tank connected to the steam chamber, the rest having a receiving portion for the iron body, the receiving portion comprising the first shifter for enabling the iron body to move the power source by the weight of the iron body, and a second shifter for enabling the iron body to shift to the first shifter by the weight of the iron body, thereby ensuring that the iron body is smoothly accommodated in the receiving portion of the rest for electrical connection whether the iron body is mounted on the rest either from above the rest or from the side thereof, the iron body and the rest comprising means for mutual electrical connection, and a steam suspending means operably responsive to the mounting of the iron body on the rest, and a stop means for suspending the water supply to the steam chamber.

8. A cordless iron according to claim 7, wherein the electrical connection is effected by a receiving means provided on the iron body and a projecting means provided in the rest, the projecting means being received by the receiving means.

9. A cordless iron according to claim 7, wherein the receiving portion for the iron body is tilted toward the electrical connection in the rest, and the first shifter comprises a plurality of rollers.

10. A cordless iron comprising an iron body including a soleplate having a heater, a rest having a connection to a power source, the rest enabling the iron body to be mounted when the iron body is not being used, a steam chamber provided in the soleplate, a water tank connected to the steam chamber, the water tank comprising a valve at an outlet operably responsive to the mounting of the iron body on the rest, the iron body and the rest comprising means for effecting mutual electrical connection, and a steam suspending means operably responsive to the mounting of the iron body on the rest, and a stop means for suspending the water supply to the steam chamber.

11. A cordless iron comprising an iron body including a soleplate having a heater, a rest having a connection to a power source, the rest enabling the iron body to be mounted when the iron body is not being used, a steam chamber provided in the soleplate, a water tank connected to the steam chamber through a water passageway, the iron body and the rest comprising means for effecting mutual electrical connection, a steam suspending means operably responsive to the mounting of the iron body on the rest, a stop means for suspending the water supply to the steam chamber, and a pump provided in the water passageway.

12. A cordless iron comprising an iron body including a soleplate having a heater, a rest having a connection to a power source, a steam chamber provided in the soleplate, a water tank connected to the steam chamber, the rest having a receiving portion for the iron body, the receiving portion comprising a first shifter enabling the iron body to move to the power source by the weight of the iron body, and a second shifter for enabling the iron body to shift to the first shifter by the weight of the iron body, thereby ensuring that the iron body is smoothly accommodated in the receiving portion of the rest for electrical connection whether the iron body is mounted either from above the rest of from the side thereof, the iron body and the rest comprising means for mutual electrical connection, and a steam suspending means operably responsive to the mounting of the iron body on the rest, a stop means for suspending the water supply to the steam chamber, the electrical connection between the iron body and the rest being effected by a receiving means provided on the iron body and a projecting means provided in the rest, the projecting means being received by the receiving means.

* * * * *